US005364582A

United States Patent [19]

Lilly

[11] Patent Number: 5,364,582

[45] Date of Patent: Nov. 15, 1994

[54] METHOD FOR PRODUCING POLYMERIC FIBERS WITH IMPROVED ANTI-STATIC PROPERTIES AND FIBERS AND FABRICS PRODUCED THEREBY

[75] Inventor: Robert L. Lilly, Asheville, N.C.

[73] Assignee: BASF Corporation, Parsippany, N.J.

[21] Appl. No.: 113,943

[22] Filed: Aug. 30, 1993

[51] Int. Cl.[5] ..... D01F 1/09

[52] U.S. Cl. ..... 264/211; 264/211.22

[58] Field of Search ..... 264/68, 211, 211.22

[56] References Cited

U.S. PATENT DOCUMENTS

| | | | |
|---|---|---|---|
| 4,065,532 | 12/1977 | Wild et al. | 264/68 |
| 5,116,897 | 5/1992 | Burton | 524/243 |
| 5,157,067 | 10/1992 | Burditt et al. | 524/270 |
| 5,236,645 | 8/1993 | Jones | 264/78 |

FOREIGN PATENT DOCUMENTS 91115155.3 7/1991 European Pat. Off. .

*Primary Examiner*—Leo B. Tentoni

[57] ABSTRACT

The present invention is directed to a method for producing polymeric fibers with improved anti-static properties and deep dyeability. The method employs anti-static agents that are solid, waxy substances at room temperature. The anti-static agent is pulverized and combined with a carrier to form a dispersion and injected into the throat of a spinning extruder. Polymeric material is added to the extruder and heated with the anti-static agent to form a melt. The melt is then extruded to form the polymeric fiber. Alternatively, the molten anti-static agent is melted and fed through heated lines into a spinning extruder. Polymeric material is added to the extruder and heated with the anti-static agent to form a melt. The melt is then extruded to form the polymeric fiber.

7 Claims, 2 Drawing Sheets

METHOD FOR PRODUCING POLYMERIC FIBERS WITH IMPROVED ANTI-STATIC PROPERTIES AND FIBERS AND FABRICS PRODUCED THEREBY

BACKGROUND OF THE INVENTION

The propensity of synthetic fibers to develop a static charge is a well known phenomenon. Static electricity is generated when two relatively non-conducting surfaces, such as those of synthetic fibers, come into close contact and are rubbed together. This leads to a continuous flow of electrons in both directions across the two surfaces. On separation the electron distribution on the surfaces is disturbed; one surface retaining more electrons than in its normal state acquires a negative charge and the other an equivalent positive charge.

Static can be controlled by eliminating the charge generation or by increasing the rate of charge dissipation. Due to the hydrophobicity of synthetic fibers, the synthetic fibers are not able to dissipate the generated electricity. Most anti-static treatments attempt to increase the hygroscopicity, (i.e. the ability of fibers to adsorb moisture from the air), to increase the rate of charge dissipation.

Anti-static treatments for synthetic fibers and fabrics generally include spray-on treatments applied to fibers after the fiber is extruded or to fabrics, after the fabric is woven or knitted.

For synthetics or polymeric materials, such as polyamide, anti-static treatment may also be achieved by mixing large quantities (20%–50%) of an anti-static agent with caprolactam in a polymerization vessel during the polymerization reaction of polyamide to produce a "master batch" of polyamide containing anti-static agent. The anti-static polyamide fiber is then produced by blending the "master batch" with virgin polyamide chips in a blender or tumbler.

However, this method has serious drawbacks as the concentration of anti-static agent is batch dependent and varies according to the requirements of the specific batch. The anti-static containing polyamide chips of the "master batch" do not blend uniformly with the virgin polyamide and the anti-static properties of the extruded fiber are not uniform. Also, this anti-static treatment to polyamide requires elaborate and expensive spinning equipment to control or regulate the rate of addition of anti-static agent. Examples of such equipment include side arm extruders and colortronics.

The present invention provides a method for addition of an anti-static agent to molten polymeric material contained in a spinning extruder without the use of equipment such as a side arm extruder. According to the method of the present invention, an anti-static agent that is solid at room temperature, is melted and added to the molten polymeric material. The method is an improvement over the prior art, as it provides an accurate and efficient method for addition of an anti-static agent to a spinning extruder, without the use of expensive equipment.

Unexpected results are achieved when fibers or fabrics are treated with the anti-static agent according to the present invention. These unexpected advantages include improved stability of the fabric to ultraviolet light, significantly improved dye lightfastness and improved dye uptake, resulting in deeper dyeing, in comparison to untreated control samples.

SUMMARY OF THE INVENTION

The present invention is directed to a method for addition of an anti-static agent to a polymeric material in a spinning extruder, wherein the method improves the anti-static properties and deep dyeability of the treated polymeric materials. The method is particularly useful for polyamide polymers, but may be used with any suitable polymeric material to be extruded such as polyester, polyethylene and polypropylene. The method employs anti-static agents that are solid, waxy substances at room temperature. The anti-static agent is fed into a standard spinning extruder. In the preferred embodiment, the solid anti-static agent is dispersed in powdered or pulverized form in a liquid carrier and injected into a spinning extruder. The carrier acts as a liquid transporting vehicle for the dispersed anti-static agent. The injection is performed with the aid of a mechanical pump. Particularly useful for the method of the present invention is a peristaltic pump. Other mechanical pumps such as metering pumps and positive displacement pumps may also be used. Polymeric material is fed into the spinning extruder from a reservoir. The anti-static agent and polymeric material are melted in the extruder at temperatures ranging from 250° C. to 285° C. Preferably the temperature is about 270° C. In an alternative embodiment the anti-static agent is first melted in a heated vessel and fed through heated feed lines by a pump to the spinning extruder. Polymeric material is also fed into the extruder, preferably in solid chip form. The anti-static agent and polymeric material are heated to a molten state in the spinning extruder at temperatures ranging from 250° C. to 285° C. and preferably about 270° C.

DRAWINGS

DETAILED DESCRIPTION OF THE INVENTION

The present invention is a method for producing polymeric fibers with improved anti-static properties and deep dyeability. In the method of the present invention an anti-static composition that is a solid, waxy material at room temperature is injected into a spinning extruder and combined in the extruder with polymeric material. The anti-static agent and polymeric material are heated together in the extruder to form a melt. The melt is then extruded to form a polymeric fiber.

In one embodiment of the invention, pulverized anti-static agent is added to an organic rosin based liquid carrier to form a dispersion. The anti-static agent and carrier dispersion are then injected via pump into the throat of a spinning extruder. Polymeric material is also fed into the spinning extruder. The anti-static agent dispersion and polymeric material are heated together in the extruder to form a melt. The temperature of the extruder is between 250° and 285° C., preferably about 270° C. The melt is then extruded to form the polyamide fiber containing the anti-static agent.

Figure 1:
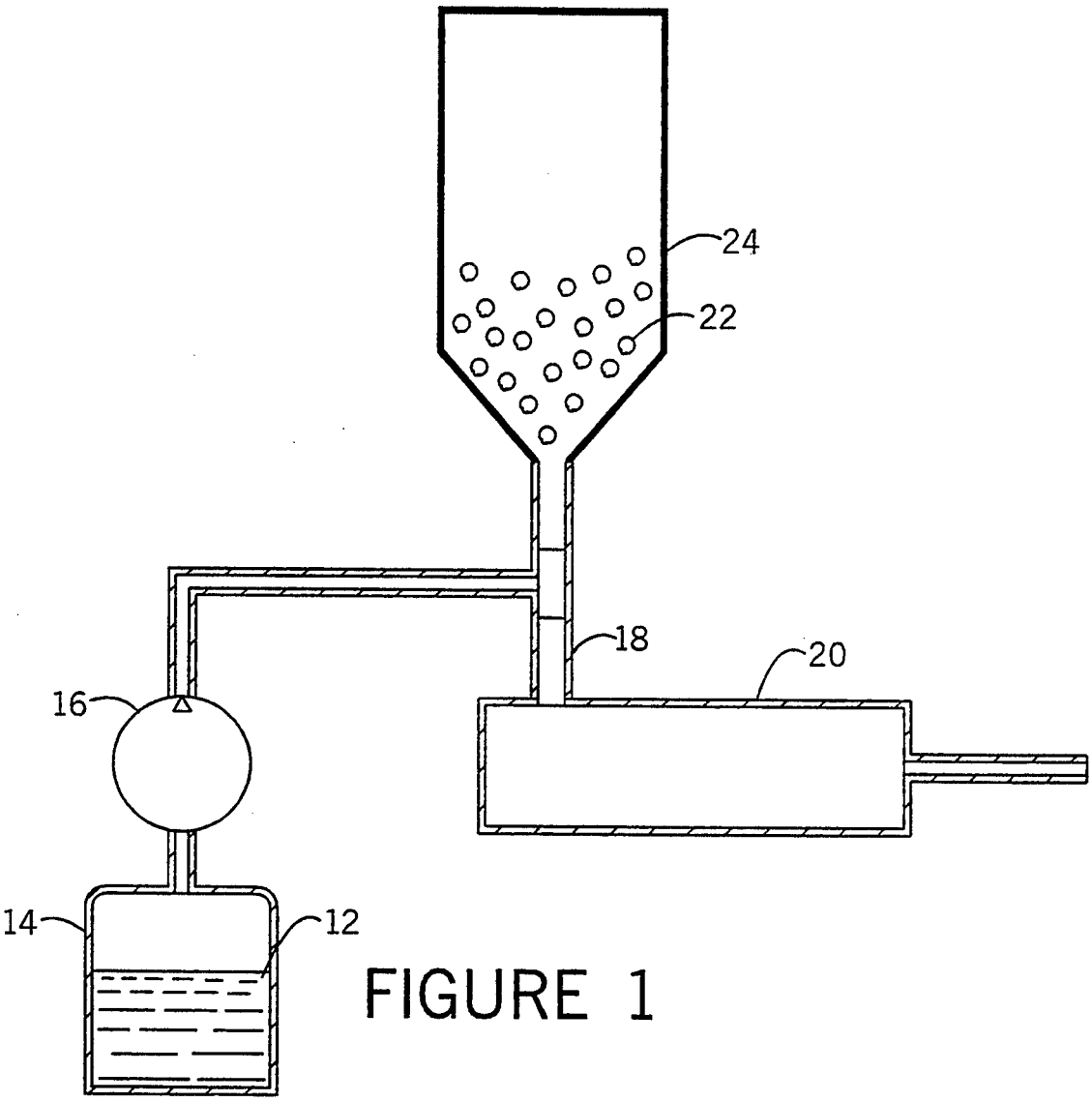
FIG. 1 shows the method of adding pulverized anti-static agent, carrier and polymer to the spinning extruder.

This embodiment is shown in FIG. 1, where a dispersion 12 of pulverized anti-static agent and liquid carrier is contained in a reservoir 14. The anti-static agent and carrier are injected via pump 16 into the throat 18 of a spinning extruder 20. Polymeric material 22 is fed from a storage tank 24 into the extruder 20 and combined therein with the anti-static agent dispersion. The polymeric material and anti-static agent dispersion are heated together in the extruder to a temperature of between 250° C. and 285° C., to form a melt.

Figure 2:
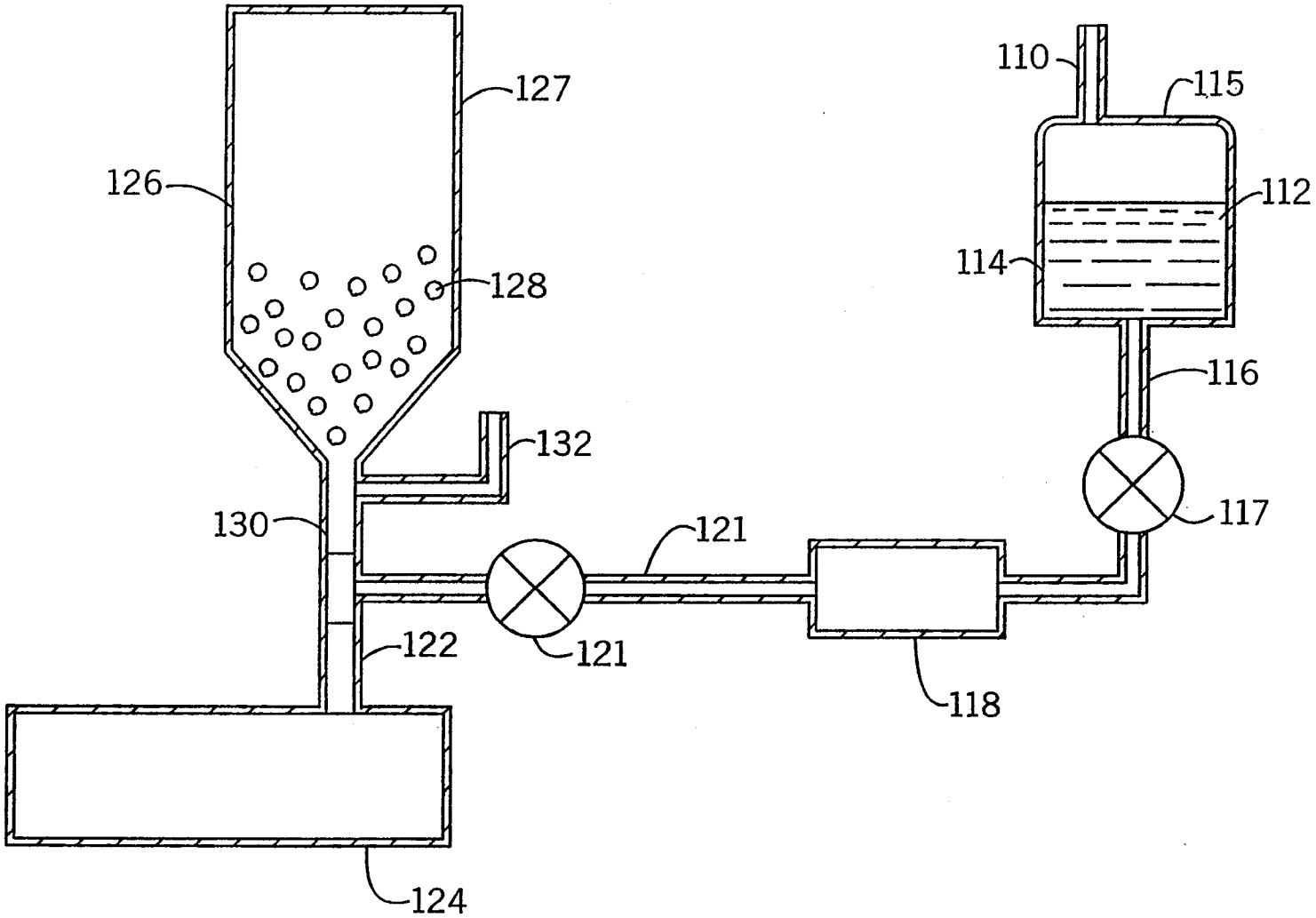
FIG. 2 shows the method of adding the molten anti-static agent via a heated inlet line to the spinning extruder.

In an alternative embodiment of the present invention, shown in FIG. 2, the anti-static agent 112 is added to a heated vessel 114 and melted at temperatures of between 60° C. and 70° C., before it is added to a spinning extruder. The vessel 114 is surrounded by a nitrogen heated blanket 115. The heated blanket helps to prevent degredation of the anti-static agent by keeping oxygen from the heated vessel. Nitrogen is supplied to the blanket 115, through nitrogen inlet 110, located at the top of the heated vessel. The melted anti-static agent is fed from the vessel 114 by a heated feed line 116 to a metering pump 118. A shut off valve 117 is located in the feed line 116 between the heated vessel and the metering pump 118. The anti-static agent is then pumped by the metering pump 118 through a heated feed line 120 to the throat 122 of a spinning extruder 124. A sample valve 121 is located between the metering pump 118 and the throat 122 of the spinning extruder 124. A storage tank 126 containing polymeric chips 128, is connected via feed line 130 to the throat 122 of the spinning extruder 124. The storage tank 126 is surrounded by a nitrogen heated blanket 127, where the nitrogen is supplied through nitrogen inlet 132, located in the base of the storage tank. The heated blanket aids in keeping the polymeric chips dry. The polymeric chips are combined in the spinning extruder 124 with the anti-static agent and heated to form a melt. The melt is then extruded to form a polymeric fiber containing anti-static agent (not shown).

Where polyamide is used as the polymeric material, the anti-static agent and polymeric material are heated together to a temperature of between 250° C and 285° C. to form a melt. Preferably the melt is heated to a temperature of 270° C.

Preferred anti-static agents include N, N-dipolyoxyethylene-N-2-hydroxyalkylamine sold under the trademark Duspar® 7500 antistatic Agent by Marubeni of Japan and a partial ester of alkoxylated amine made by BASF and described in U.S. Pat. No. 5,116,897 to Burton, which is hereby incorporated by reference. The partial ester of alkoxylated amine has the formula

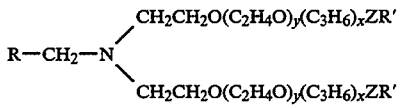

$$R-CH_2-N\begin{matrix}\diagup CH_2CH_2O(C_2H_4O)_y(C_3H_6)_xZR' \\ \diagdown CH_2CH_2O(C_2H_4O)_y(C_3H_6)_xZR'\end{matrix}$$

wherein R is a $C_{1-9}$ alkyl group or hydrogen, Z is a difunctional chain modifier group. R' is a $C_{1-4}$ alkyl group or hydrogen and x and y have a value between 10 and 50.

The anti-static agent is a linear polyester preferably prepared via the base-catalyzed transesterification of dimethyl azelate with a N-methyl diethanol amine initiated ethylene oxide/propylene oxide block polymer. The N-methyl diethanolamine block polymer is preferably prepared by reacting methyldiethanolamine with (MDEA) with ethylene oxide followed by reaction with propylene oxide and then chain modification. Chain modifiers useful with the anti-static agent are difunctional and preferably have acidic or nearly analogous reactive functionality. Preferred chain modifiers are dibasic acids having less than 18 carbon atoms and derivatives thereof. The oxyalkylene chains are preferably end-capped. The cap may be a short chain alkyl or alkyl carbonyl group, yielding ether or ester derivatives, respectively. Examples of suitable capping groups are alkyl radicals of $C_1$–$C_4$, with methyl caps being preferred.

The anti-static agent is utilized in an amount between 0.5% to 12.0% by weight and preferably between 0.8% and 2.5% by weight based on the total weight of the composition including polymeric material, anti-static agent and carrier.

The carrier for the molten anti-static agent is preferably an organic rosin based material containing surfactants and diluents formulated and sold by Ferro Corp. of Cleveland, Ohio. The carrier formulation is described in U.S. Pat. No. 5,157,067 to Burditt et al., issued Oct. 20, 1992 which is hereby incorporated by reference. The carrier includes at least one non-polymeric organic rosin ester, such as a lower alkyl ester of an abietic acid based rosin and a surfactant which can be nonionic, cationic, anionic or amphoteric. Preferably, the surfactant is an adduct of poly(12-hydroxystearic acid). The carrier may also include a low viscosity organic diluent such as mineral oil. In addition to dispersing the anti-static agent, the carrier aids in improving the compatibility of the anti-static agent with the polyamide.

The anti-static agent and carrier are utilized in a mixture of between 30% and 50% anti-static agent and between 50% and 70% carrier, based on the combined weight of carrier and anti-static agent. The preferred mixture is a 50/50 mixture of anti-static agent and carrier.

The method of the present invention is useful with any suitable polymeric material to be extruded such as polyamide, polyester, polyethylene and polypropylene. The invention is particularly useful with polyamide polymers. Examples of useful polyamide polymers include nylon polymers such as nylon-6, nylon 12, nylon 6/T and nylon-66, and mixtures and copolymers thereof. An example of a useful nylon-6 polymer for purposes of the present invention is Ultramid®, nylon-6 manufactured and sold by BASF Corporation of Freeport, Tex. The polymeric material is preferably added to the spinning extruder in the form of solid chips.

The final yarn is preferably 20 to 70 denier and commonly has 12 to 28 filaments per yarn. The final product can be treated like any other polymer of the kind without the additive. In the case of nylon tricot, it may be warped, knitted, dyed and cut for garments.

For purposes of the present invention, knit hose leg test samples containing the anti-static agent and control samples without the anti-static agent were prepared on a FAK circular knitter (4.0 tension setting. The construction used was two ends (two-plied, of 40/13 final denier/filaments per yarn) to give 80/26 (final denier/-filaments per yarn) knitted hoselegs. The hose legs were scoured, air-dried, ironed at 300° F., and conditioned in a low humidity environment for more than 24 hours prior to testing.

Surface resistivity measurements were made according to AATCC Test Method 76-1982 (electrical resistivity of fabrics) and AATCC Test Method 84-1982 (electrical resistivity of yarns), using a Hewlett Packard High Resistivity Meter Model No. HP4329A in conjunction with a Hewlett-Packard Resistivity Cell Model No. HP-16008A. Conditioning and measurements were performed at 25% relative humidity and 77° F. in a Tenny Environmental Chamber.

Fabric-to-metal de-cling periods were measured according to AATCC Test Method 115-1980 at 20% relative humidity and 73° F.

Physical and chemical analyses were performed according to routine laboratory procedures and are set forth in the following examples and tables. Results of these analyses show that the samples treated with the anti-static agent by the method of the present invention, demonstrate improved stability to ultraviolet light, significantly improved dye lightfastness and dye uptake, resulting in deeper dyeing, when compared to untreated control samples.

The following examples are set forth as illustrative of the present invention, to enable one skilled in the art to practice the invention. These examples are not to be read as limiting the invention as defined by the claims set forth herein.

EXAMPLES

In the following examples anti-static agent #1 is N,N-dipolyoxyethylene-N-2-hydroxyalkylamine sold under the trademark Duspar® 7500 Antistatic Agent by Marubeni of Japan. Samples were treated with a 50% concentration of Duspar®7500 Antistatic Agent in a liquid carrier formulated as described in U.S. Pat. No. 5,157,067 and sold by Ferro Corp. of Cleveland, Ohio.

The bath ratio in all examples is the ratio of dye liquor weight to fiber weight in the dye bath. All percentages are by weight and based on total weight of the dye bath, unless otherwise indicated.

EXAMPLE 1

SCOURING AND DYEING PROCEDURE FOR TESTING DYEFASTNESS UPON EXPOSURE TO ULTRAVIOLET RADIATION

Knitted nylon hoseleg samples were prepared from a nylon-6 polymer sold by BASF Corp. under the trademark Ultramid® nylon 6. One sample was treated with an anti-static agent according to the method defined in the present invention and set forth herein above. An untreated sample served as the control. The samples were dyed in separate baths by the following procedure.

1. The yarns were heat set at 360° F. for 45 seconds prior to dyeing.
2. Intimate apparel Dyeing
   30:1 Bath Ratio The cold bath was set with:

2.0% Apcolev® WN[1] leveling agent (weight is based on total fiber weight)
0.25 g/l TSP[2]
2.0 g/l Eulysin® WP[3] dye bath auxiliary
Shade 1-Cranberry
0.09% Nylanthrene® Rubin 5 BLF acid red dye 22
3.00% Nylanthrene® Pink BLRF pink dye
1.00% Polar Brilliant® Red B acid violet dye 54
Shade 2-Navy
6.0% Tectilon® Blue 4R acid blue dye 27
0.75% Tectilon® Yellow yellow dye 219

The pH was set to 9.5 with TSP or Acetic Acid. Samples were then heated to 96° C. (205° F.) at the low heat setting and run for 60 minutes at 96° C. This was followed by rinsing, first in warm water, then cold water. Samples were then tumbled dry in polyester bags.

3. After treatment
   40:1 bath ratio

Cold bath was set with:

1.0% Acetic Acid (28%)
3.0% Tannic Acid

The bath was heated to 71° C. (160° F.) and run for 10 minutes. 4.0% of a fixing agent XP-100available from Piedmont Chemical Company, was added and the bath was then run for 20 minutes. The bath was cooled, followed by cool water rinsing and subsequent warm water rinsing.

After rinsing, a cold bath was prepared as follows:

40:1 Bath ratio, where cold bath was set with 0.5% Peregal® ST[4] dyeing Assistant Samples were heated to 60° C. (140° F.) and run for 10 minutes, followed by cold rinse. The samples were then tumbled dry in polyester bags.

The dyed samples were tested for UV stability as shown by strength retention, and the results are set forth in Table 1. The samples were also tested for dye-lightfastness, indicated by delta E color change after 80 hours exposure in Xenon Weatherometer, and the results are shown in Table 2.

[1] Apcolev® WN is a leveling agent for acid dyes on polyamide, sold by Apollo Chemical Corp. of Burlington, N.C. Weight is based on the weight of the fiber. [2] TSP is trisodium phosphate. [3] Eulysin® WP is a dye bath auxiliary used for pH control when dying polyamide fibers with acid dyes. It is sold by BASF Corp. of Parsippany, N.J. [4] Peregal® ST is used to increase dye receptivity of synthetic fibers and is sold by International Specialty Products of Wayne, N.J.

TABLE 1

UV Stability (Percent strength retention) of Knitted Hoselegs After 80 Hours Exposure in Xenon Weatherometer

| Sample | Dye Shade** % strength retention (cranberry) | Dye Shade** % strength retention (navy) |
|---|---|---|
| 1.8% Anti-static agent* (in fiber) | 70 | 82 |
| control | 59 | 75 |

*50% concentrate of Duspar® 7500 Antistatic Agent in liquid carrier.
**Higher value indicates better stability, lower value indicates poorer stability of polymeric material to UV exposure.

TABLE 2

DYEFASTNESS (delta E color change) OF KNITTED HOSELEGS AFTER 80 HOURS EXPOSURE IN XENON WEATHEROMETER

| Sample | (delta E color change)** Dye Shade = cranberry | Dye Shade = navy |
|---|---|---|
| 1.8% Anti-static agent #1* (in fiber) | 1.13 | 0.70 |
| control | 3.91 | 2.18 |

*50% concentrate of Duspar® 7500 Antistatic Agent in liquid carrier.
**Lower value = better dye lightfastness, higher value = poor dye lightfastness.

EXAMPLE 2

SCOURING AND DYING PROCEDURE FOR ANTI-STATIC TREATED NYLON AND CONTROL (UNTREATED) FOR DEEP DYEING

Knitted pairs of anti-static treated and untreated hoseleg samples were dyed in separate baths per Research Dye Lab Procedure No. LP-D 3016C dyeing procedure, as described below. Dyed pairs of the hose legs were tested with ACS color measurement instrument for deep dyeability. These results are set forth in Table 3.

SCOUR

30:1 Bath Ratio

Set cold bath with:

0.25 grams/liter Triton® X-100[1] non-ionic surfactant 0.50 grams/liter TSP[2]

[1] Triton® X-100 is a nonionic surfactant sold under the trademark Triton® by Rohm and Haas of Philadelphia, Pa. [2] TSP is trisodium phosphate.

The bath was heated to 70° C. and run 20 minutes at 70° C. This was followed by rinsing, first with hot water then with cold water.

The samples were dyed according to the following process.

(Kiton Blue Sensitive Dyeing)

30:1 Bath ratio cold bath was set with:

1.0 grams/liter sodium acetate 0.60% Savdolen® Blue E-BL-C.I. Acid Blue 45

Formic Acid to pH 3.0.

The bath was then heated to 95° C., followed by rinsing in hot water, then rinsing in cold water. The samples were then extracted and air dried.

TABLE 3

ACS COLOR MEASUREMENTS (L* VALUES) OF ANTI-STATIC TREATED DYE UPTAKE OF TREATED VS. CONTROL KNITTED HOSELEG SAMPLES

| Sample | Hose Construction | Dye Uptake (ACS L Values)** |
|---|---|---|
| 1.8% Anti-Static Agent #1* (in fiber) | Single-end hoseleg | 41.28 |
| control | " | 45.54 |
| 1.8% Anti-Static Agent #1* (in fiber) | Double-end hoseleg | 39.50 |
| control | " | 42.55 |
| 1.8% Anti-Static Agent #1* (in fiber) | Triple-end hoseleg | 38.69 |
| control | " | 43.07 |

*50% concentrate of Duspar® 7500 Antistatic Agent in liquid carrier.
**Lower values = deeper dyeing; higher values = lighter dyeing.

TABLE 4

FIBER ANALYSIS-
PHYSICAL PROPERTIES OF DRAWN YARNS

| Sample | Denier | Elongation % | Tenacity g/den | Uster % CV | Shrinkage % |
|---|---|---|---|---|---|
| 1.8% Anti-static Agent #1* (in fiber) | 41.8 | 42 | 5.3 | 0.64 | 13.5 |
| 1.2% Anti-static Agent #2** (in fiber) | 41.9 | 41 | 4.5 | 0.70 | 13.0 |
| Control | 42.1 | 38 | 5.5 | 0.79 | 12.0 |

*Concentration of 50% Duspar® 7500 Antistatic Agent in liquid carrier.
**Anti-static agent #2 is made by BASF Corp., Wyandotte, Michigan and is identified with the code ES-7776.

TABLE 5

CHEMICAL PROPERTIES OF DRAWN YARNS

| Sample | Viscosity RV | Amine End Group (AEG) (meq/Kg) | Carboxyl End Group (CEG) (meq/kg) | Methanol Extractables Total (%) |
|---|---|---|---|---|
| 1.8% Anti-static Agent #1* (in fiber) | 2.86 | 29.7 | 39.1 | 3.79 |
| 1.2% Anti-static Agent #2** (in fiber) | 2.78 | 29.4 | 42.4 | 3.19 |

TABLE 5-continued

CHEMICAL PROPERTIES OF DRAWN YARNS

| Sample | Viscosity RV | Amine End Group (AEG) (meq/Kg) | Carboxyl End Group (CEG) (meq/kg) | Methanol Extractables Total (%) |
|---|---|---|---|---|
| Control | 2.80 | 35.7 | 48.0 | 2.34 |

*Concentration of 50% Duspar® 7500 Antistatic Agent in liquid carrier.
**Anti-static agent #2 is made by BASF Corp. Wyandotte, Michigan and is identified with the code ES-7776.

TABLE 6

ELECTRICAL RESISTIVITY OF HOSELEG FABRICS*
(SURFACE RESISTIVITY)

| SAMPLE | SURFACE RESISTIVITY (Ohms/Square of Fabric)* 0 WASHINGS | 10 WASHINGS (DETERGENT) | 25 WASHINGS (DETERGENT) |
|---|---|---|---|
| Anti static Agent #1** (in fiber) | $5.5 \times 10^{14}$ | $4.5 \times 10^{14}$ | $3.8 \times 10^{14}$ |
| Anti-static Agent #2*** (in fiber) | $2.4 \times 10^{14}$ | $1.6 \times 10^{15}$ | $1.1 \times 10^{15}$ |
| Control | $2.2 \times 10^{15}$ | $9.5 \times 10^{16}$ | — |

*Measured by AATCC Test Method 76-1982, using a Hewlett Packard High Resistivity Meter Model No. HP4329A in conjunction with a Hewlett-Packard Resistivity Cell Model No. HP-16008A. Conditioning and measurements were performed at 25% Relative Humidity and 77° F. in a Tenny Environmental Chamber. Units of Measurement = ohms × width of specimen/distance between electrodes. Smaller exponential number indicates decrease in surface resistance (increase in conductance).
**Duspar® 7500, in concentration of 50% Duspar® 7500 Antistatic Agent in liquid carrier.
***Anti-static agent #2 is made by BASF Corp., Wyandotte, Michigan, and is identified with the code ES-7776.

TABLE 7

ELECTRICAL RESISTIVITY OF YARNS
(SURFACE RESISTIVITY)

| SAMPLE | SURFACE RESISTIVITY (Ohms/cm)* 0 WASHINGS | 10 WASHINGS (DETERGENT) | 25 WASHINGS (DETERGENT) |
|---|---|---|---|
| Anti static Agent #1** (in fiber) | $5.3 \times 10^{9}$ | $5.1 \times 10^{9}$ | $4.5 \times 10^{9}$ |
| Anti-static Agent #2*** (in fiber) | $1.1 \times 10^{10}$ | $1.1 \times 10^{10}$ | $6.6 \times 10^{9}$ |
| Control (with liquid carrier) | $1.8 \times 10^{12}$ | $1.4 \times 10^{11}$ | $4.2 \times 10^{11}$ |
| Control (without liquid carrier) | — | $1.4 \times 10^{11}$ | $4.2 \times 10^{11}$ |

*Measured by AATCC Test Method 84-1982, using a Hewlett Packard High Resistivity Meter Model No. HP4329A in conjunction with a Hewlett-Packard Resistivity Cell Model No. HP-16008A. Conditioning and measurements were performed at 25% relative humidity and 77° F. in a Tenny Environmental Chamber. Increasing exponential number indicates decrease in surface resistance (increase in conductance).
**Duspar® 7500, used in concentration of 50% Duspar® 7500 Antistatic Agent in liquid carrier.
***Anti-static agent #2 is made by BASF Corp., Wyandotte, Michigan, and is identified with the code ES-7776.

TABLE 8

ELECTROSTATIC CLINGING OF HOSELEG FABRICS
(FABRIC-TO-METAL CLING TEST)

| SAMPLE | FABRIC CLING TIME (minutes)* 0 WASHINGS | 10 WASHINGS (DETERGENT) | 25 WASHINGS (DETERGENT) |
|---|---|---|---|
| 1.8% Anti- | 1.5 | 0.52 | 0.58 |

TABLE 8-continued

| ELECTROSTATIC CLINGING OF HOSELEG FABRICS (FABRIC-TO-METAL CLING TEST) | | | |
|---|---|---|---|
| | FABRIC CLING TIME (minutes)* | | |
| SAMPLE | 0 WASHINGS | 10 WASHINGS (DETERGENT) | 25 WASHINGS (DETERGENT) |
| static Agent #1** (in fiber) 1.2% Anti-static Agent #2*** (in fiber) | 2.0 | 1.5 | >5.0 |
| Control | 2.2 | >10.0 | >10.0 |

*Measured by AATCC Test Method 115-1980, at 20% relative humidity and 73° F. Lower numerical values indicate enhanced anti-static performance.
**Duspar ® 7500, used in concentration of 50% Duspar ® 7500 Antistatic Agent in liquid carrier.
***Anti-static agent #2 is made by BASF Corp., Wyandotte, Michigan, and is identified with the code ES-7776.

I claim:

1. A method for producing extruded polymeric fibers with anti-static properties and deep dyeability, comprising introducing an anti-static agent into fiber forming polymer by the steps of a) forming a dispersion of a pulverized polyoxyethylene alkylamine anti-static agent which anti-static agent is a solid waxy material at room temperature with a carrier which carrier comprises organic rosin materials and a surfactant;

b) injecting the anti-static agent and carrier dispersion into a spinning extruder;

c) adding fiber forming polymer to the spinning extruder;

d) heating together the dispersion and polymer to form a melt in the extruder; and e) extruding the melt to form a polymeric fiber containing anti-static agent.

2. The method of claim 1, wherein the anti-static agent used therein is N,N -dipolyoxyethylene-N-2 hydroxyalkyl amine.

3. The method of claim 1, wherein the carrier used therein is an organic rosin based composition material, containing surfactant, and diluent.

4. The method of claim 1, wherein the polymer used therein is polyamide.

5. The method of claim 1, wherein the polymer is added to the spinning extruder in solid chip form.

6. The method of claim 1, wherein the step of injecting anti-static agent into the extruder is accomplished by means of a mechanical pump.

7. The method of claim 1, wherein the anti-static agent is utilized in an amount between 0.5% and 12.0% by weight.

* * * * *